US010647130B2

(12) United States Patent
Cheng

(10) Patent No.: US 10,647,130 B2
(45) Date of Patent: May 12, 2020

(54) HYBRID PRINTING PROCESS

(71) Applicant: Jim Cheng, Poway, CA (US)

(72) Inventor: Jim Cheng, Poway, CA (US)

( * ) Notice: Subject to any disclaimer, the term of this patent is extended or adjusted under 35 U.S.C. 154(b) by 0 days.

(21) Appl. No.: 13/844,866

(22) Filed: Mar. 16, 2013

(65) Prior Publication Data

US 2014/0267474 A1 Sep. 18, 2014

(51) Int. Cl.
*B41J 3/54* (2006.01)
*B41J 11/00* (2006.01)

(52) U.S. Cl.
CPC ..... *B41J 3/546* (2013.01); *B41J 11/002* (2013.01); *B41J 11/0015* (2013.01)

(58) Field of Classification Search
CPC ..... B41J 3/546; B41J 11/0015; B41J 11/002
See application file for complete search history.

(56) References Cited

U.S. PATENT DOCUMENTS

| | | | | |
|---|---|---|---|---|
| 6,543,163 | B1 * | 4/2003 | Ginsberg | 40/219 |
| 2010/0101842 | A1 * | 4/2010 | Akiba et al. | 174/257 |
| 2014/0147678 | A1 * | 5/2014 | Melbye | 428/423.5 |

* cited by examiner

*Primary Examiner* — Justin Seo
(74) *Attorney, Agent, or Firm* — Steven W. Webb

(57) ABSTRACT

A new method of combining pad printing with digital printing is presented, where the pad printer lays down a layer of ink and adhesive primer to accept the digital image. The pad printed surface is baked and a high-definition digital image is printed on top of the primer coat. The result is clear-coated and the coating treated with UV curing.

2 Claims, 1 Drawing Sheet

HYBRID PRINTING PROCESS

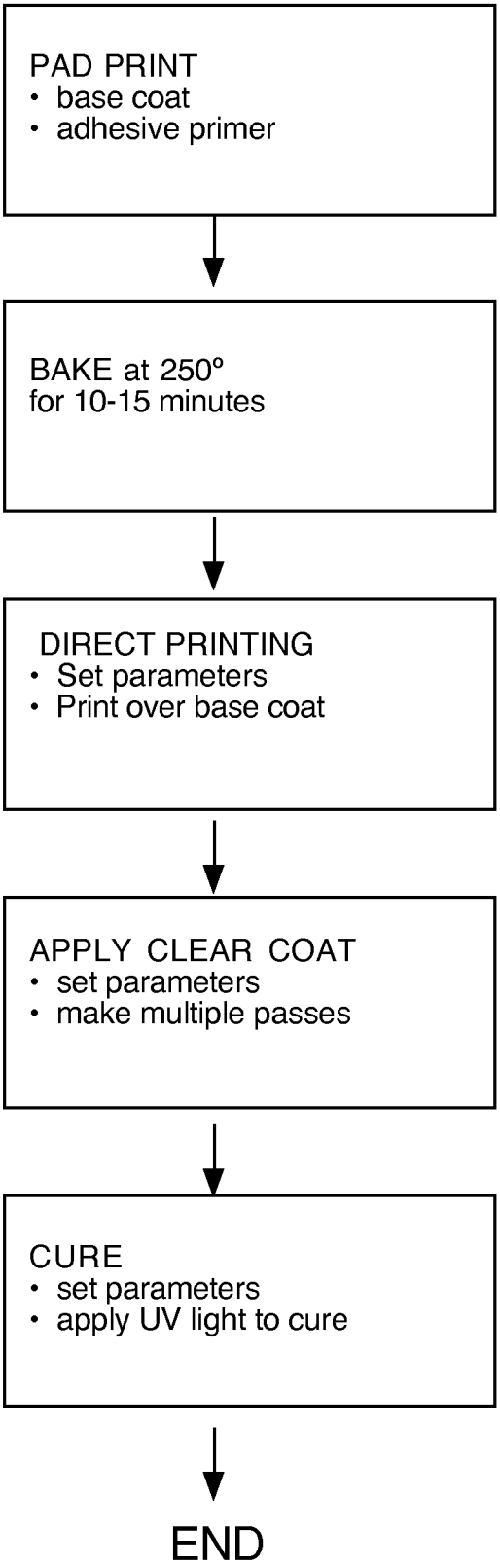
HYBRID PRINTING PROCESS

HYBRID PRINTING PROCESS

FIELD OF THE INVENTION

The present invention relates to the fields of pad printing and digital printing.

BACKGROUND OF THE INVENTION

There are several processes for performing combination printing of flat surfaces, involving multiple layers of print. The underlying print layers are usually cured or hardened by radiation, chemical treatment, or heat before top layers are added.

As an example, U.S. Pat. No. 6,443,058 to Stadler, et al. teaches a process combining two ink systems. The underlying substrate is first printed with a solvent-based or radiation-cured ink and then with at least one offset-typical ink. The patent teaches inline implementation via a hybrid press, having a flexo printing unit and a downstream offset printing unit. A UV, electron-beam or air-stream dryer is also integrated into the flexo printing unit, or, alternatively, a UV, electron-beam or air-stream drying unit is used.

Specifically for pad printing of curved or irregular surfaces, a new process is required to combine the advantages of pad printing with the hybrid process concept.

SUMMARY OF THE INVENTION

The present invention combines existing, well-defined pad printing technology with digital printing, such as ink-jet printing, to produce a multiple-layer printed surface. The process involves pad-printing a primer coat onto a surface, such as a single color, then baking said surface at 250 degrees Fahrenheit, followed by a digital printing phase.

Digital printing involves using an ink-jet or other digital printing means to print a design on the baked surface, followed by clear-coating and a final ultraviolet light curing stage. Preparing for digital printing includes selecting the print resolution, the drop size for the ink jet, the number of passes, the focal point, and the color profile. Color profile can include the percentage of color coverage and adjustments based on CMYK proportions.

A clear coating is selectively applied to the printed surface by selecting the percentage of clear coverage and selecting the profile, including drop size for the sprayer, the resolution, and the number of passes. Finally, the clear coat is cured with ultraviolet light.

For example, french nails can be printed using this process. A white background can be printed on with pad printing, comprised of artwork and an adhesive primer. Ink jet printing of certain patterns can be done on top of this, because in general, pad printing is unstable. The ink jet on top of the adhesive primer prevents smearing of the printed pattern.

BRIEF DESCRIPTION OF THE DRAWINGS

FIG. 1 is a block diagram of the invention process.

DESCRIPTION OF THE PREFERRED EMBODIMENT

FIG. 1 shows the process of the invention. The process is applied to flat parts or parts that can be temporarily flattened for printing purposes during direct printing. The parts are oriented diagonally to the direct printing print head travel path, at approximately 45 degrees of arc.

The part temperature should be kept between 78 and 84 degrees Fahrenheit, outside of baking time. During the printing processes, ambient temperature should be between 77 and 79 degrees Fahrenheit and the relative humidity should stay between 40 and 55 percent.

Pad printing is performed on the flattened part, putting down a layer of primer base. The preferred embodiment uses TCP series 9900 ink, which is an acrylic. This base is selected because it is compatible with ultraviolet ink.

The resulting product is then baked at 250 degrees Fahrenheit for ten to fifteen minutes.

The part is left to cool, then direct printing is performed on it. The preferred embodiment uses an ink jet printer to directly print the part.

The ink jet is configured by selecting the resolution of the image, the ink drop size, the number of passes required to print the image, and the focal point of the image. A color profile is also selected, with percentage of color coverage and the CMYK adjustment the primary modes.

Following direct printing, a clear coat is selectively applied to the image on the part. The inputs to this step are percentage of clear coat coverage, and coat spray parameters drop size, resolution, and number of coating passes.

The coated part is now cured with an industry-standard ultraviolet curing system, where the focal point of the UV beam is set along with the conveyor belt speed.

This invention has other applications, potentially, and one skilled in the art could discover these. The explication of the features of this invention does not limit the claims of this application; other applications developed by those skilled in the art will be included in this invention.

What is claimed is:

1. A method of hybrid printing of hard-surface parts, the method comprised of the steps of assembling a hybrid printing apparatus, the hybrid printing apparatus comprised of a pad printing system, a direct printing system, a clear coat sprayer, and an ultraviolet (UV) curing system, the pad printing system comprised of a pad printer and an oven, the direct printing system comprised of a digital printer, assembling the parts to be printed on, flattening said parts if they are not flat, pad printing a primer base on said parts using the pad printer, baking said parts after pad printing in the oven at 250° Fahrenheit for ten to fifteen minutes, allowing the parts to cool to less than 84° Fahrenheit, orienting the parts diagonally to the digital printer print head travel path, at 45 degrees of arc, on the digital printer, selecting the resolution of the image, the ink drop size, the number of passes required to print the image, the focal point of the image, and the color profile, printing an image on the parts with the digital printer, selecting on the clear coat sprayer, the percentage of coverage, the drop size, the resolution, and the number of passes, applying a clear coat on the parts using the clear coat sprayer, setting the UV curing system focal point and conveyor speed, curing the clear coat using the UV curing system.

2. The method of hybrid printing of hard-surface parts as in claim 1 where the primer base is TCP series 9900 ink and the digital printer is an ink jet printer.

* * * * *